US005253473A

United States Patent [19]

Duva

[11] Patent Number: 5,253,473

[45] Date of Patent: Oct. 19, 1993

[54] HEAT REGENERATIVE EXTERNAL COMBUSTION ENGINE

[75] Inventor: Anthony W. Duva, Middletown, R.I.

[73] Assignee: The United States of America as represented by the Secretary of the Navy, Washington, D.C.

[21] Appl. No.: 35,867

[22] Filed: Mar. 23, 1993

[51] Int. Cl.[5] ..... F02G 3/02

[52] U.S. Cl. ..... 60/39.462; 60/39.63; 60/736

[58] Field of Search ..... 60/39.462, 39.6, 39.63, 60/736; 91/499, 503, 507; 114/20.2

[56] References Cited

U.S. PATENT DOCUMENTS

| | | | |
|---|---|---|---|
| 2,575,070 | 11/1951 | Reed et al. | 60/736 |
| 2,599,480 | 6/1952 | Pfenninger | 60/736 X |
| 2,975,588 | 3/1961 | Smith | 60/39.462 X |
| 3,151,527 | 10/1964 | Hamlin | 91/507 |
| 3,564,846 | 2/1971 | Moore | 60/39.462 X |
| 4,336,686 | 6/1982 | Porter | 60/39.63 |

*Primary Examiner*—Michael Koczo

*Attorney, Agent, or Firm*—Michael J. McGowan; Prithvi C. Lall; Michael F. Oglo

[57] ABSTRACT

A heat regenerative external combustion engine is disclosed herein. The engine includes fuel inlet means which extends along the exhaust passage and/or combustion chamber in order to preheat the fuel. To provide for preheating by gases in both the combustion chamber and the exhaust passage, the combustion chamber is arranged annularly around the drive shaft and between the cylinders. This configuration also is advantageous in that it reduces the noise of combustion. The engine of the invention is particularly well-suited for use in a torpedo.

7 Claims, 2 Drawing Sheets

HEAT REGENERATIVE EXTERNAL COMBUSTION ENGINE

STATEMENT OF GOVERNMENT INTEREST

The invention described herein may be manufactured and used by or for the Government of the United States of America for governmental purposes without the payment of any royalties thereon or therefor.

CROSS REFERENCES TO RELATED PATENT APPLICATIONS

The instant application is related to two co-pending U.S. patent applications entitled EXTERNAL COMBUSTION ENGINE HAVING A COMBUSTION EXPANSION CHAMBER Ser. No. 08/035,862; and COOLANT SUBSYSTEM FOR A TORPEDO PROPULSION SYSTEM Ser. No. 08/035,864 having same filing date.

BACKGROUND OF THE INVENTION (1) Field of the Invention

The present invention relates generally to external combustion engines. More particularly, this invention relates to a heat regenerative external combustion engine.

(2) Description of the Prior Art

One of the Navy's in-service torpedoes, which is of conventional design, employs an external combustion expander-type engine in conjunction with monopropellant fuel. To operate the engine, a solid initiator monopropellant fuel is first combusted in the combustion chamber, producing a hot, high-pressure, energized gas which commences drive action of the torpedo and initiates the entry of a liquid sustainer monopropellant fuel into the combustion chamber. The liquid sustainer fuel, which is at ambient temperature, enters the chamber from the forward side of the chamber. Heat which is generated in the combustion of the initiator monopropellant effects combustion of the initial quantity of sustainer monopropellant which is admitted to the combustion chamber. Further entry and combustion of the sustainer monopropellant fuel in the combustion chamber continues in a self-sustaining manner due to the high temperature and pressure in the chamber resulting from combustion of the sustainer monopropellant. Due to this self-feeding combustion mechanism, the efficiency of a conventional external combustion torpedo engine depends in part upon the amount of energy that is required in order to heat the sustainer monopropellant in the combustion chamber from ambient temperature to its combustion temperature.

There are several drawbacks to the conventional external combustion engines used in torpedoes. When a torpedo is launched at a relatively low speed from a shallow depth, the pressure in the combustion chamber is low, and as a result, unburned fuel can be carried through the torpedo engine. This results in inefficiency of operation and can lead to afterburning in the drive shaft. Furthermore, combustion of a monopropellant fuel in an external combustion engine can generate substantial noise. A loud combustion process is undesirable in a torpedo engine as it can facilitate discovery of the location of the launching vessel and the torpedo.

SUMMARY OF THE INVENTION

It is an object of the invention to provide an external combustion expander-type engine having improved efficiency.

It is another object of the invention is to provide a external combustion engine in which afterburning in the exhaust channel is substantially prevented.

Yet another object of the invention is to provide an external combustion engine which is less noisy than an external combustion engine of conventional design.

These and other objects of the invention will become more apparent from the following description.

The above objects of the invention are realized by providing a heat regenerative external combustion engine. The heat regenerative external combustion engine of the invention comprises a combustion chamber for combusting a monopropellant fuel in order to form an energized gas. The energized gas is then passed through a rotary valve to a cylinder having a reciprocating piston disposed therein. The gas is expanded in moving the piston, thereby driving a drive shaft. The expanded gas is removed from the cylinder through the rotary valve and is transferred to an exhaust passage, through which it is removed from the engine. The engine further includes fuel inlet means for supplying a monopropellant fuel to the combustion chamber. The fuel inlet means extends along at least a portion of the length of the exhaust passage and/or combustion chamber in order to preheat the fuel. Preferably, the combustion chamber is annular and is disposed around the exhaust passage, with the cylinders being positioned around the chamber. The fuel inlet means preferably includes a plurality of narrow channels which are formed in parallel around the exhaust passage between the exhaust passage and the combustion chamber, and which feed the fuel to the chamber proximate the rear end of the chamber. The engine of the invention is particularly well suited for use in a torpedo.

Another embodiment of the invention is a method for increasing the efficiency of an external combustion engine which includes a combustion chamber for combusting a fuel to produce an energized gas, a cylinder containing a piston for performing work using the energized gas, an exhaust passage for expelling, or removing, the expanded gas from the cylinder, and a rotary valve for transferring the energized gas from the combustion chamber to the cylinder and transferring expanded gases from the cylinder to the exhaust passage. The method of the invention comprises the step of positioning an elongated fuel inlet means along a portion of the exhaust passage and/or the combustion chamber in a manner appropriate to preheat the fuel using heat generated by the energized gas and/or the exhaust gas.

Another embodiment of the invention is a method for reducing the noise produced by an external combustion expander-type engine which includes an annular combustion chamber for combusting a fuel to produce an energized gas, a cylinder barrel containing a plurality of cylinders in a ring-type arrangement, each of which includes a reciprocating piston for performing work upon contact with a portion of the gas, an exhaust passage for removing the expanded gas from the engine, and a rotary valve for transferring energized gas from the combustion chamber to the cylinder and transferring spent gas from the cylinder to the exhaust passage. The method of the invention comprises the step of positioning the annular combustion chamber between the exhaust passage and the plurality of cylinders, within the cylinder barrel, in order to reduce the noise emission of the combustion process.

DESCRIPTION OF THE PREFERRED EMBODIMENT

Figure 1:
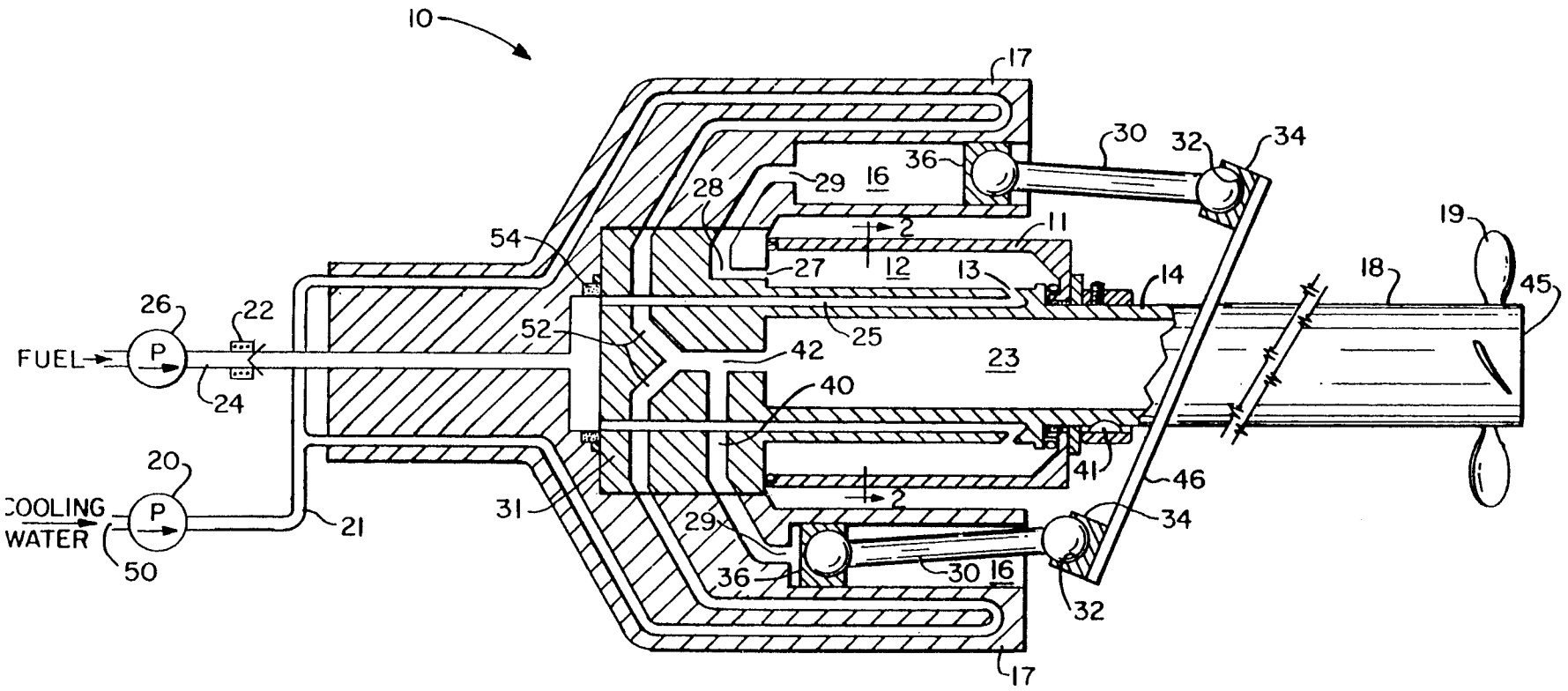
FIG. 1 is a schematic longitudinal sectional view of an external combustion engine for a torpedo in accordance with a preferred embodiment of the present invention.

With reference to FIG. 1, heat regenerative external combustion engine for a torpedo is generally designated by the numeral 10.

Figure 2:
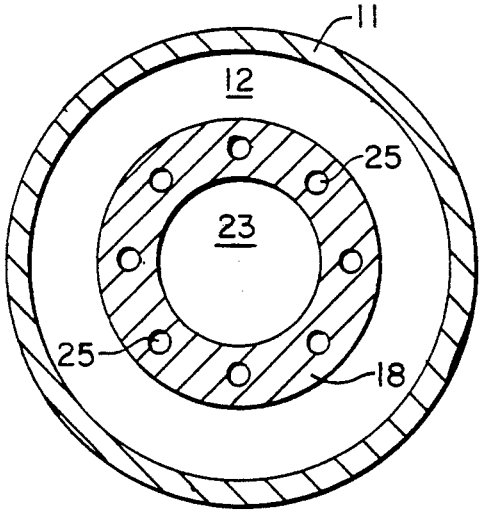
FIG. 2 is a transverse sectional view of the external combustion engine taken along line 2—2 of FIG. 1.

Torpedo engine 10 has an annular combustion chamber 12, shown in FIGS. 1 and 2, which is formed around a central rotatable drive shaft 18 in a coaxial arrangement. The drive shaft 18 is hollow and elongated, having a generally cylindrical wall 14 which defines an axial exhaust duct 23 therein. A propeller 19 is mounted at the outer or rearward end of the drive shaft 18. The combustion chamber 12 includes an outer shell 11 which is shaped as a hollow cylinder having an open top and a bottom having a central round aperture which receives the drive shaft 18. The shell 11 serves as the outer and rear walls of the combustion chamber 12. The inner wall of the combustion chamber 12 is defined by the wall 14 of the drive shaft 18. The forward wall of the combustion chamber is defined by a rotary valve 31 which is coaxial with and splined to the drive shaft 18. The combustion chamber is held in place along the drive shaft 18 by the rotary valve 31 at the forward end and a Woodruff key 41 at the rear end.

Fuel is fed to the combustion chamber 12 through a central fuel feed line 24. As shown in FIGS. 1 and 2, the fuel feed line 24 diverges into eight narrow fuel inlet channels 25 which extend longitudinally through the rotary valve 31 and through the drive shaft wall 14 along the length cf the combustion chamber 12. The connection between fuel feed line 24 and the feed inlet channels 25 is sealed by a ring-shaped seal 54. A fuel inlet port 13 is formed at the end of each channel 25 for feeding the fuel into the combustion chamber 12 through the drive shaft wall 14. This configuration of channels 25 provides for the transfer of heat from the exhaust duct 23 and the combustion chamber 12 to the fuel in order to preheat the fuel prior to its entry into the combustion chamber 12.

The chamber 12 has an energized gas outlet port 27 at its forward end through which energized combustion gas is transferred via the rotary valve 31 to six cylinders 16. The cylinders 16 are arranged around the combustion chamber 12, are evenly spaced from each other and from the combustion chamber 12, and are housed in a single cylinder block or barrel 17. This arrangement reduces noise emission from the combustion process, as the noise generated in the combustion chamber is muffled by the cylinders 16 and cylinder barrel 17. The energized gas from the combustion chamber 12 is expanded (sometimes in the jargon of the art called "spent") in the cylinders 16 in order to drive the drive shaft 18, thereby turning the propeller 19 in a manner which is known to one skilled in the art.

The engine 10 also includes a coolant subsystem having a coolant pump 20 and a coolant passage 21 for circulating seawater around the combustion chamber 12 and the cylinders 16 during operation of the engine, as described below in further detail.

The torpedo engine of the invention operates in the following manner. Before the torpedo is launched, the combustion chamber 12 contains a solid initiator monopropellant fuel which is ignited when the torpedo is launched. As it combusts, the initiator monopropellant generates a hot, high-pressure, energized gas which commences drive action of the torpedo engine 10 and opens a poppet valve 22 in the fuel inlet port 24 to the chamber 12 to admit a liquid sustainer propellant fuel into the engine 10. The sustainer propellant, which is a monopropellant fuel, such as OTTO Fuel II, is pumped by a pump 26 through the fuel inlet line 24 into the torpedo engine. The fuel in the fuel inlet line 24 enters the annular arrangement of narrow fuel inlet channels 25. The fuel in the channels 25 is preheated due to heat exchange with gases in the exhaust duct 23 and the combustion chamber 12. The preheated fuel then enters the combustion chamber 12 at its rearward end, through the fuel inlet ports 13. Heat generated by combustion of the initiator propellant commences combustion of the sustainer fuel to form a hot, high-pressure, energized gas. Commonly, the operating pressure in the combustion chamber 12 is on the order of 700-900 p.s.i. As a portion of the energized gas in the combustion chamber 12 is removed from the combustion chamber at its forward end through the energized gas outlet port 27, additional sustainer propellant is pumped into the combustion chamber 12 at its rearward end and is combusted due to the high temperature of the chamber resulting from previous combustion of sustainer propellant. Thus, combustion continues for as long as a sufficient quantity of sustainer propellant enters the combustion chamber 12.

The backstroke of pistons 30 in cylinders 16 causes energized gas to be expelled, of removed from the combustion chamber 12 at the energized gas outlet port 27 through an energized gas channel 28 of the rotary valve 31. The rotary valve 31, which is splined to the drive shaft 18, operates generally in a manner which is well known to one skilled in the art. The energized gas from the combustion chamber 12 is transferred by the energized gas channel 28 in sequence to the six cylinders 16, two of which are shown in the Figure. The energized gas is delivered sequentially via the energized gas channel 28 to the inlet 29 of each cylinder. The inlets 29 are positioned around the rotary valve 31 for sequential registry with the channel 28 in a known manner as the rotary valve rotates. It is to be appreciated that the primary structural difference between the rotary valve 31 of the invention and prior art rotary valves is that according to the invention, the inlet to the energized gas channel 28 is on the rearward, rather than forward, end of the rotary valve 31.

Each cylinder 16 contains a reciprocating piston 30 which is connected at its outer end 32, outside the cylinder body, to a non-rotating (but pivoting) wobble plate 34 which is configured in a known manner. The energized gas which is distributed to the cylinders 16 performs work on the pistons 30 sequentially by individually moving the inner end 36 of each piston outward toward the rear end of the torpedo engine. Due to the interconnection of all of the pistons 30 by the tilted wobble plate 34, outward movement of one particular piston causes a piston on the directly opposite, axially spaced side of the drive shaft to move inward, away from the rear end of the torpedo. As a particular piston moves inward, it forces expanded gas through an exhaust gas channel 40 in the rotary valve 31 in a known manner. The exhaust gas in channel 40 is introduced into an exhaust gas-coolant channel 42 in the rotary valve 31 through which it is transferred to the exhaust duct 23. The exhaust gas is then emitted from the torpedo engine 10 into the seawater at the rear or outer end 45 of the exhaust duct 23.

The wobble plate 34 is connected by a bearing to a tilted, rotating swash plate 46. The non-rotating, tilting movement of the wobble plate 34 rotates the swash plate 46 continuously in one direction to drive the central drive shaft 18, which is rigidly connected to the swash plate 14 in a co-axial arrangement. Rotation of the drive shaft 18 drives the propeller 19, which is fixed to the outer end of the drive shaft 18.

The torpedo engine 10 has a coolant subsystem that includes a seawater inlet 50 which is opened after the torpedo is launched. The inlet 50, which is near the combustion chamber 12, admits cooling water into the coolant passage 21. The seawater at inlet 50 is pumped through the coolant passage 21 by the coolant pump 20. The coolant passage 21 includes annular segments formed around the outer surfaces of each of the six cylinders 16. After circulating around the combustion chamber 12 and cylinders 16, the seawater in passage 21 enters a coolant channel 52 in the rotary valve 16 in a conventional manner and is transferred into the exhaust gas-coolant channel 42 in the rotary valve 16, at which point it is mixed with exhaust gas and subsequently removed from the torpedo engine with the exhaust gas through the exhaust duct 23.

While the external combustion engine of the preferred embodiment has cooling water passages which provide cooling to the cylinders, it is possible, although not necessary, to also include a water jacket around the combustion chamber in engines in which the fuel in the fuel inlet channels 25 sufficiently cools the combustion chamber 12.

The heat regenerative external combustion engine of the invention reduces energy costs, as less heat energy is required in the combustion chamber 12 in order to bring the chamber 12 to the appropriate combustion temperature. As a result, complete combustion occurs in the combustion chamber, and after-burning in the drive shaft therefore is eliminated.

It is to be understood that various changes and details, materials, steps, and arrangement of parts, which have been herein described and illustrated in order to explain the nature of the invention, may be made be those skilled in the art, within the principle and scope of the invention as expressed in the appended claims.

What is claimed is:

1. A heat regenerative external combustion engine, comprising:

a combustion chamber for combusting a monopropellant fuel to form an energized gas;

at least one cylinder fluidly connected to the combustion chamber and having a reciprocating piston disposed therein, the energized gas being expanded in the cylinder to move the piston;

a drive shaft connected to and driven by the piston;

an elongated exhaust passage fluidly connected to each of the at least one cylinder through which expanded gas is expelled from the engine;

a rotary valve for transferring the energized gas from the combustion chamber to the cylinder and for transferring the expanded gas from the cylinder to the exhaust passage;

fuel inlet means for supplying a monopropellant fuel to the combustion chamber, the fuel inlet means extending along a portion of at least one of the exhaust passage and the combustion chamber in order that the gas in the at least one of the exhaust passage and the combustion chamber preheats the fuel; and said combustion chamber being annular and formed around the exhaust passage.

2. A heat regenerative external combustion engine, comprising:

a combustion chamber for combusting a monopropellant fuel to form an energized gas;

at least one cylinder fluidly connected to the combustion chamber and having a reciprocating piston disposed therein, the energized gas being expanded in the cylinder to move the piston;

a drive shaft connected to and driven by the piston;

an elongated exhaust passage defined by a tubular wall fluidly connected to each of the at least one cylinder through which expanded gas is expelled from the engine;

a rotary valve for transferring the energized gas from the combustion chamber to the cylinder and for transferring the expanded gas from the cylinder to the exhaust passage; and fuel inlet means for supplying a monopropellant fuel to the combustion chamber, the fuel inlet means comprising a plurality of narrow channels formed in the tubular wall extending along a portion of at least one of the exhaust passage and the combustion chamber in order that the gas in the at least one of the exhaust passage and the combustion chamber preheats the fuel.

3. A heat regenerative external combustion engine, comprising:

a combustion chamber for combusting a monopropellant fuel to form an energized gas;

a plurality of cylinders disposed around the combustion chamber, each cylinder being fluidly connected to the combustion chamber and having a reciprocating piston disposed therein, the energized gas being expanded in the cylinder to move the piston;

a drive shaft connected to and driven by the piston;

an elongated exhaust passage fluidly connected to each of the plurality of cylinders through which expanded gas is expelled from the engine;

a rotary valve for transferring the energized gas from the combustion chamber to the cylinders and for transferring the expanded gas from the cylinders to the exhaust passage; and fuel inlet means for supplying a monopropellant fuel to the combustion chamber, the fuel inlet means extending along a portion of at least one of the exhaust passage and the combustion chamber in order that the gas in the at least one of the exhaust passage and the combustion chamber preheats the fuel.

4. An external combustion engine, comprising:

a combustion chamber;

at least one cylinder;

a rotary valve for transferring a gas from the combustion chamber to the at least one cylinder;

elongated passage means connected to the cylinder for removing the gas from the engine;

and fuel inlet means for feeding fuel to the combustion chamber;

the combustion chamber comprising an annular region arranged concentrically around the elongated passage means; and the fuel inlet means being in thermal contact with the elongated passage means in a manner such that gas in the passage means heats the fuel in the fuel inlet means.

5. An external combustion engine according to claim 4, wherein the fuel inlet means comprises a plurality of narrow channels.

6. An external combustion engine according to claim 5, wherein:

the passage means is defined by a tubular wall;

and the plurality of narrow channels are formed in the tubular wall.

7. A heat regenerative external combustion engine, comprising:

a plurality of cylinders housed in a cylinder block, each cylinder being fluidly connected to the combustion chamber and having a reciprocating piston disposed therein, the energized gas being expanded in the cylinder to move the piston;

a drive shaft connected to and driven by the piston;

and elongated exhaust passage fluidly connected to each of the plurality of cylinders through which expanded gas is expelled from the engine;

a rotary valve for transferring the energized gas from the combustion chamber to the cylinders and for transferring the expanded gas from the cylinders to the exhaust passage;

fuel inlet means for supplying a monopropellant fuel to the combustion chamber, the fuel inlet means extending along a portion of at least one of the exhaust passage and the combustion chamber in order that the gas in the at least one of the exhaust passage and the combustion chamber preheats the fuel; and the combustion chamber being positioned between at least two of the plurality of cylinders, within the cylinder block, in order to reduce noise emission from the engine.

* * * * *